United States Patent [19]

Kato et al.

[11] 4,326,857

[45] Apr. 27, 1982

[54] PRODUCTION OF A GAS OF A HIGH HEATING VALUE FROM COAL

[75] Inventors: Tsutomu Kato, Kawaguchi; Mamoru Kaiho, Toride, both of Japan

[73] Assignee: Director-General of Agency of Industrial Science and Technology, Tokyo, Japan

[21] Appl. No.: 192,509

[22] PCT Filed: Jun. 15, 1979

[86] PCT No.: PCT/JP79/00153

§ 371 Date: Feb. 15, 1980

§ 102(e) Date: Feb. 15, 1980

[87] PCT Pub. No.: WO80/00085

PCT Pub. Date: Jan. 24, 1980

[30] Foreign Application Priority Data

Jun. 15, 1978 [JP] Japan ..... 53/72433

[51] Int. Cl.[3] ..... C10J 3/00

[52] U.S. Cl. ..... 48/210; 201/31; 201/34

[58] Field of Search ..... 48/210, 202; 201/34, 201/36, 31; 208/8 R; 585/733; 202/129

[56] References Cited

U.S. PATENT DOCUMENTS

| | | | |
|---|---|---|---|
| 2,187,872 | 1/1940 | Winkler et al. | 48/202 |
| 3,284,317 | 11/1966 | Jahnig et al. | 201/31 |
| 3,607,158 | 9/1971 | Deut et al. | 48/210 |
| 3,847,567 | 11/1974 | Kalina | 48/202 |
| 3,988,236 | 10/1976 | Albright et al. | 48/210 |

FOREIGN PATENT DOCUMENTS

| | | |
|---|---|---|
| 47-10110 | 5/1972 | Japan . |
| 50-106868 | 8/1975 | Japan . |

*Primary Examiner*—S. Leon Bashore
*Assistant Examiner*—Michael L. Goldman
*Attorney, Agent, or Firm*—Schwartz, Jeffrey, Schwaab, Mack, Blumenthal & Koch

[57] ABSTRACT

The present invention relates to a process for the production of a gas having a high heating value and a gasification furnace used for carrying out the process. The process of this invention is characterized in that a powdery coal is reacted with a hydrogen gas at a temperature of between 400° and 900° C. and a pressure of 20 and 100 Kg/cm$^2$ in such a state that the powdery coal forms a layer on a dispersing plate from the surface of which the hydrogen gas is emitted and which is inclined so that the coal layer may move thereon in the down grade direction thereof. The gasification furnace of this invention is characterized by the provision of a housing 11 which defines therein a reaction chamber, and a dispersing plate 36 provided in the housing for dividing the housing into an upper space A and a lower space B and laterally inclined with a predetermined gradient.

15 Claims, 4 Drawing Figures

PRODUCTION OF A GAS OF A HIGH HEATING VALUE FROM COAL

TECHNICAL FIELD

This invention relates to a process for the production of a gas having a high heating value by hydrogenolytic gasification, under pressure, of coals, and to a gasification furnace (a reactor for the hydrogenolytic gasification) for carrying out the process. According to the present invention, coals may be gasified, with a good efficiency, to yield a gas of a high heating value while satisfying conditions required for the hydrogenolytic gasification under pressure and permitting the operation of the gasification furnace to be smoothly conducted.

BACKGROUND ART

As a process for the gasification of coals, there have been hitherto practically employed a fixed bed gasification process, a fluidized bed process, an entrained bed process and the like process, wherein air or oxygen is used as a gasification agent. A gas obtained by these gasification processes has a heating value of 1,000–4,000 Kcal/m$^3$. In order to produce a gas having a heating value near that of natural gasses (6,000–9,900 Kcal/m$^3$) by the gasification of coals, it is necessary to use hydrogen as a gasification agent. Since reaction of coals with hydrogen greatly differs from that with oxygen, however, it is impossible to obtain satisfactory results when the conventional process in which air or oxygen is to be used as a gasification agent is adopted as is.

The present inventors have made various studies with a view to developing a process in which the hydrogenolytic gasification, under pressure, of coals can occur with a good efficiency. To collect basic data concerning hydrogenolytic gasification reactions, under pressure, of coals, the present inventors have first carried out reactions of a coal with hydrogen by passing a pressurized hydrogen gas, under various reaction conditions, through a reaction tube packed with a coal powder while externally heating the tube by means of an electric furnace. The results of the experiments under various pressures are shown in Table 1.

TABLE 1

| Raw material | Char obtained by carbonizing Taiheiyo coal* at 500° C. (particle size: 30–60 mesh) | | | | | |
|---|---|---|---|---|---|---|
| Heat-up rate (°C./min) | 2 | | | | | |
| Reaction temperature (°C.) | 750 | | | | | |
| Retention time at the reaction temperature(hr) | 3 | | | | | |
| Hydrogen feed rate(l/hr) | 500 | | | | | |
| Pressure(Kg/cm$^2$) | 1 | 10 | 20 | 30 | 40 | 70 |
| Gross heating value of gas product(Kcal/m$^3$) | 3700 | 4510 | 5505 | 5985 | 6029 | 9206 |
| Conversion rate of raw material(%) | 21.5 | 30.3 | 39.2 | 41.7 | 51.9 | 60.0 |

*non-caking bituminous coal

It will be seen from Table 1 that both the gross heating value of the gas product and the conversion rate of the raw material increase with the rise of the reaction pressure and, hence, a relatively large amount of a gas having the high heating value near that of natural gases is obtainable when the hydrogenolytic gasification is conducted under a pressure of about 70 Kg/cm$^2$.

Next, the change in temperature in the coal layer with the lapse of time and the change in amount of methane generated with the lapse of time were investigated in association. The results are graphically shown in FIGS. 1 and 2. In each of these graphs, the axis of abscissa represents time lapse of the experiment (hr), while the left and right axes of ordinate stand for amount of methane generated (l/hr) and temperature (°C.), respectively. In the graphs, the line A shows the change in temperature within the coal layer with the lapse of time while the line B shows the change in amount of methane generated with the lapse of time.

The results, in the case of 10 Kg/cm$^2$ of reaction pressure, shown in FIG. 1 indicate that the amount of methane generated significantly increases at a temperature in the coal layer of 650° C. and more, and reaches its maximum at 750° C. But, the gross heating value of the gas product is small as appreciated from the experiment results shown in Table 1. And, in the reaction of this case, the temperature in the coal layer increases proportionally with the increase in the outside temperature of the reaction tube, showing that no great generation of heat due to the gasification reaction occurs.

In the results, shown in FIG. 2, in the case of 70 Kg/cm$^2$ of reaction pressure, two peaks are present, with respect to the amount of methane generated, in a lower temperature side (approximately 550° C.) and a higher temperature side (approximately 750° C.). These two peaks appear when the reaction is performed under a pressure of 30 Kg/cm$^2$ or more. When the lower temperature side peak of the amount of methane generated appears, the temperature in the coal layer increases instantaneously from about 400° C. to 800° C., showing the occurrence of an abrupt exothermic reaction.

From the foregoing results of the basic reaction experiments, it may be concluded that in order to obtain a gas having such a high heating value as that of natural gases, it is necessary to allow such the hydrogenolytic gasification reaction of coals as represented in FIG. 2 by the lower temperature side peak with respect to the amount of methane generated to efficiently occur so as to obtain a gas containing methane as its major component and having a high heating value, while utilizing the abrupt exothermic phenomenon, which occurs simultaneously therewith, for maintaining the temperature inside a reaction furnace in a range suitable for the gasification.

DISCLOSURE OF THE INVENTION

The present invention is aimed at the provision of a reaction process which permits the hydrogenolytic reaction, under pressure, of coals to occur in the most favorable manner, and a gasification furnace for carrying out the process.

The process for the production of a gas having a high heating value from a coal in accordance with the present invention comprises the step of reacting a powdery coal with hydrogen at a temperature of between 400° and 900° C. and pressure of between 20 and 100 Kg/cm$^2$ in such a state that the powdery coal forms a layer on a dispersing plate from the surface of which the hydrogen is emitted and which is inclined so that the coal layer may move thereon in the down grade direction thereof.

The coals applicable to the present invention include lignite, brown coal, bituminous coal, anthracite and their denaturated or treated materials. These coals are provided for the reaction in the form of a powder having a particle size not greater than 6 mm, preferably a grain size of 5–100 mesh (in terms of Tyler mesh).

The dispersing plate applicable to the present invention is a perforated plate formed of a heat-resistant material such as a stainless steel, high nickel alloy and cobalt alloy and having small perforations of 0.5–3 mm, preferably 1–2 mm diameter. These small perforations are desired to be distributed in the plate with a space of 5 mm–5 cm in both longitudinal and widthwise directions. While it is desired that as large the number of the perforations as possible be distributed in the dispersing plate, the number is, in practice, suitably determined in view of the strength of the dispersing plate in association with the amount of hydrogen capable of flowing therethrough.

The flow velocity of the hydrogen gas to be emitted from the perforations of the dispersing plate is suitably 0.5–2 times, preferably 0.8–1.5 times the minimum fluidized velocity of the coal particles employed. The gradient of the dispersing plate is suitably 1/100–40/100, preferably 3/100–30/100.

The reaction in the present invention is performed at a temperature of 400°–900° C., preferably 750°–850° C. and under a pressure of 20–100 Kg/cm$^2$, preferably 30–80 Kg/cm$^2$.

The amount of hydrogen used in the present invention is, in terms of volume in normal state, not greater than 1 m$^3$ and generally in the range of 0.3–0.7 m$^3$ per 1 Kg of the coal. If necessary, the hydrogen gas may be used in the form of a mixture with other gases such as steam.

The height of the layer of the coal powder layer formed on the dispersing plate is suitably adjusted according to the scale of a reactor for the hydrogenolytic gasification (hereinafter referred to simply as gasification furnace) and is not specifically limited. The height is generally 3 cm–1 m, preferably 15–70 cm. The coal layer formed on the dispersing plate moves thereon in the down grade direction thereof because the plate is inclined and because hydrogen is upwardly blown off therethrough.

The gasification furnace for carrying out the gasification reaction according to the present invention is characterized by the provision of a housing defining a reaction chamber therein, a hydrogen gas dispersing plate for dividing the housing into an upper space and a lower space, a coal supply conduit opening into one end of the upper space, a discharge conduit opening into the other end of the upper space for discharging a gasification residue of the coal, a gas discharge conduit opening into the upper space for discharging a gasification product gas of the coal, and a hydrogen gas supply conduit opening into the lower space, the hydrogen gas dispersing plate being inclined downward from the coal supply side to the coal gasification residue discharge side so as to accelerate the movement of a coal layer formed on the dispersing plate in the direction from the coal supply side to the coal gasification residue discharge side.

A first feature of this invention resides in that a residence time of the coal in the furnace can be adjusted to any time period suitable for performing the hydrogenolytic reaction of the coal. The optimum residence time of the coal in the gasification furnace is determined by the reaction pressure and temperature. For example, in case where char obtained by low temperature carbonization of Taiheiyo coal is subjected to the hydrogenlytic gasification, a violent exothermic reaction takes place for about one minute under a reaction pressure of 70 Kg/cm$^2$ and at a reaction temperature of 750° C., yielding a gas product having the maximum heating value, as will be appreciated from FIG. 2. By adjusting the residence time of the coal in the furnace in the range of from 30 sec. to 10 min., such a gas product having a high heating value may be effectively obtained. In the present invention, the residence time of the coal in the furnace ranges generally 20 sec. to 15 min., preferably from 30 sec. to 10 min.

In the present invention, since the height of the coal layer formed on the hydrogen gas dispersing plate is considerably lower than those with fixed bed gasification furnaces, the coal can be heated to a desired reaction temperature within a short period of time by passing a preheated hydrogen has through the coal layer via dispersing plate. Therefore, the residence time of the coal in the furnace may be regarded as being nearly equal to the time required for the coal to travel on the dispersing plate. Thus, in the case of the present invention, the residence time in the furnace can be easily adjusted to an optimum value suitable for the reaction by changing the down grade of the dispersing plate and/or the length of the dispersing plate in the direction of the movement of the coal. That is, the hydrogenolytic gasification, under pressure, of coals in accordance with the process of the present invention is conducted with the use of a dispersing plate having such a gradient and a length that the residence time in the furnace of the powdery coal layer is in the range of from 20 sec. to 15 min.

The second feature of this invention lies in that, unlike with a fluidized bed gasification furnace and the like, the phenomenon of inverse mixing of coal particles in the gasification furnace hardly occurs. That is, while there may be produced a local mixing state in each portion in the gasification furnace, no inversed mixing of the coal particles occurs in the down grade direction of the dispersing plate of the gasification furnace. Thus, the gasification furnace may be regarded as being of a piston flow reaction type. Accordingly, the coal thrown in the gasification furnace can pass a preheat zone, a reaction zone and a reaction completion zone successively in the direction of the movement and there is formed within the furnace a temperature gradient which is maximum in the reaction zone. As a result, the coal in the reaction zone is never cooled by the coal of lower temperatures which have been freshly supplied in the furnace so that the reaction temperature abruptly increases, for example to 800°–1,100° C., within a short period of time. By this, the rate of the hydrogenolytic gasification abruptly increases, whereby enabling to produce a gas of a high calorific value and containing mainly methane, ethane or the like in a large amount within a short period of time. In the example shown in FIG. 2, since the reaction tube is heated and cooled from outside to keep its heat-up rate constant of 2 °C./min., though the methane generating reaction occurs at a temperature of 460° C. to once increase the temperature of the coal layer to near 800° C., the reaction is immediately interrupted by giving the heat to and being cooled with the reaction tube, and then occurs again at a temperature of near 750° C. to give a methane generation peak. In the gasification process according to this invention, the exothermic reaction between hydrogen and coal is allowed to sufficiently proceed, without restriction, so that when the reaction is initiated at 460° C., the temperature of the coal immediately rises to 800° C. or more and the higher temperature side exothermic reaction as shown in FIG. 2 occurs simultaneously. Thus, in the present invention, the hydrogenolytic gasification reaction to produce a gas having a high heating value is achieved in an extremely efficient manner in accordance with such principle. In practice, when the temperature of the furnace becomes 1,100° C. or more, troubles will be induced. But, it is possible to take counter-measures for this such as control of the preheat temperature of the hydrogen to be supplied for preventing the temperature in the furnace from being increased and in order to ensure safe operation. Meanwhile, when the hydrogenation reaction at the maximum temperature is completed, the coal loses its volatile matters to form, in the furnace, a char of mostly carbonaceous matters and having an increased ash content. For this reason, the hydrogenation reaction rate becomes lowered so that content of methane and the like in the gas product decreases and, on the other hand, the unreacted hydrogen content increases, resulting in the lowering in the heating value of the gas product. Accordingly, it is necessary to discharge the char remaining in the furnace and having lowered reactivity at once after the hydrogenolytic gasification is practically completed. By feeding each optimum amount of the hydrogen gas to respective one of the coal layers in the aforementioned preheat zone, reaction zone and reaction completion zone, the content of unreacted hydrogen in the gas product can be further reduced. While such a procedure can be adopted in the moved layer according to this invention, it is difficult, with the conventional fluidized bed type reaction furnaces, to conduct the reaction corresponding to the portion in which the production of the gas having a high heating value by the hydrogenolytic gasification is in a peak, since coal particles in the furnace are completely mixed with each other.

In addition to the feature, as described above, that a gas having a high heating value near that of natural gases is obtainable by freely adjusting the reaction time, the present invention has another advantage in that the unreacted char is recovered in a granulated form by effectively utilizing caking phenomenon of the coal layer which occurs during the hydrogenolytic gasification under pressure. Coals or chars obtained by low temperature carbonization thereof are complicated hydrocarbon polymeric substances and show a caking property in the coal layer at near 500° C. at which the hydrogenolytic gasification under pressure begins to occur. Namely, it is known that, with caking coals, softening and caking phenomenon occurs, even under normal pressure, at 380° C., and becomes most intensive at about 450° C. and they are solidified at 550° C. or more. Basic experimental results reveal that when coals such as Horonai coal and Taiheiyo coal showing non-caking property at normal pressure, are subjected to an atmosphere of at least 30 Kg/cm$^2$ hydrogen, the resulting residual char after the reaction is solidified, through caking, in the form of sticks. This is attributed to the fact that when the coals, even if they are non-caking coals, are reacted with hydrogen, substances showing a caking property and formed in the coals can soften and melt the coals to yield cokes. Thus, it is necessary to take some countermeasures so as to cope with the caking phenomenon when carrying out the hydrogenolytic gasification under pressure to obtain a gas having a high heating value near that of natural gases. With the conventional fluidized bed type reaction furnace, it is a general method to previously subject the coals to partial oxidization so as to prevent the coals from caking within the furnace. This method has, however, a defect that an energy conversion efficiency of the gasification is lowered because the partial oxidization reduces the heating value of the coals. According to the present invention, the coal particles are granulated simultaneously with the hydrogenolytic gasification thereof under pressure to form granules having particles sizes of 0.5–30 mm so that the gasification furnace may be smoothly operated while excluding any troubles resulting from the caking phenomenon. This is attained because the thickness of the coal layer moving on the dispersing plate is suited to the formation of granules from powder and because the residence time of the coal in the furnace is relatively so short that the granules can be taken out from the furnace before they grow to have excessively large particle sizes.

In respect to the thickness of the coal layer, the process of this invention is featured in that the thickness is smaller than in other gasification processes. For example, assuming that 10 tons of a coal are contained in the furnace, the height of the general fluidized bed will be about 8 m in case the furnace has a diameter of 2 m, whereas the height will be 0.7 m in the present invention in case the furnace has a width of 2 m and a length of 15 m and, thus, only about one-tenth that in the fluidized bed gasification process.

Description will be given hereinbelow in connection with the granulation time. In case where coals are granulated with a binder by tumbling at normal temperature, a granulation time of at most several minutes is sufficient to form granules having diameters of about up to 2 mm. When coals are granulated by a hot processing, less time is required since the coal particles by themselves are softened and show caking property. When the granulation time exceeds 15 minutes, there is caused a danger of agglomeration of the whole coal layer. In the present invention, the residence time of coal in the furnace is in the range of 20 sec. to 15 min., which is a suitable condition for the above-described hot processing.

Thus, according to the process of this invention for obtaining a gas having a high heating value similar to that of natural gases, an abrupt exothermic hydrogenolytic gasification reaction is completed by the action of the hydrogen emitting from the dispersing plate during the coal layer formed on the inclined dispersing plate is moved and transported under a pressure of about 20 Kg/cm$^2$ or more for 20 sec. to 15 min. while discharging unreacted chars in the form of granules formed due to the caking property of the coal, thereby permitting the hydrogenolytic gasification to be carried out smoothly.

BRIEF DESCRIPTION OF DRAWINGS

FIG. 1 shows the results obtained when hydrogenation reaction was performed under a pressure of 10 Kg/cm$^2$, while FIG. 2 shows the results under a pressure of 70 Kg/cm$^2$. In these graphs, lines A and B show the change in temperature in the coal layer and the change in amount of methane generated, respectively with the lapse of time.

BEST MODE OF CARRYING OUT THE INVENTION

The preferred embodiments of the present invention will be described below in more detail with reference to the drawings.

Figure 1:
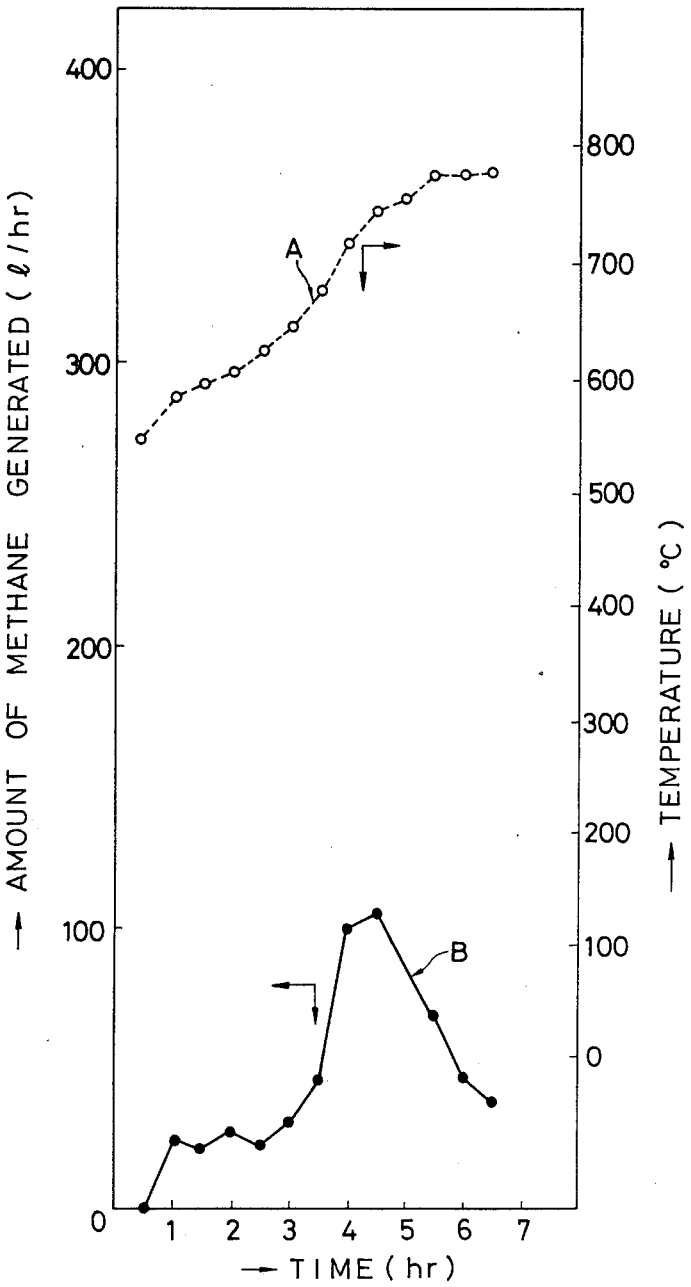
FIGS. 1 and 2 are graphs each showing the change in amount of methane generated and in temperature in the coal layer with the lapse of time.
Figure 2:
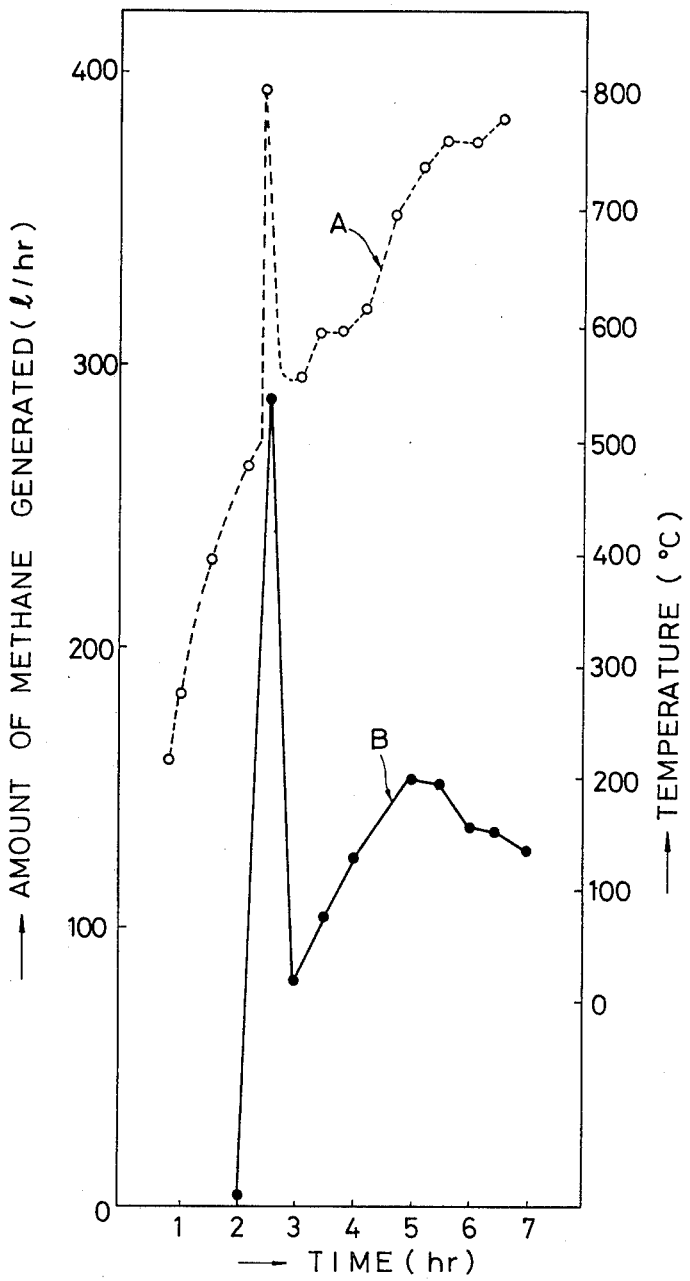
Figure 3:
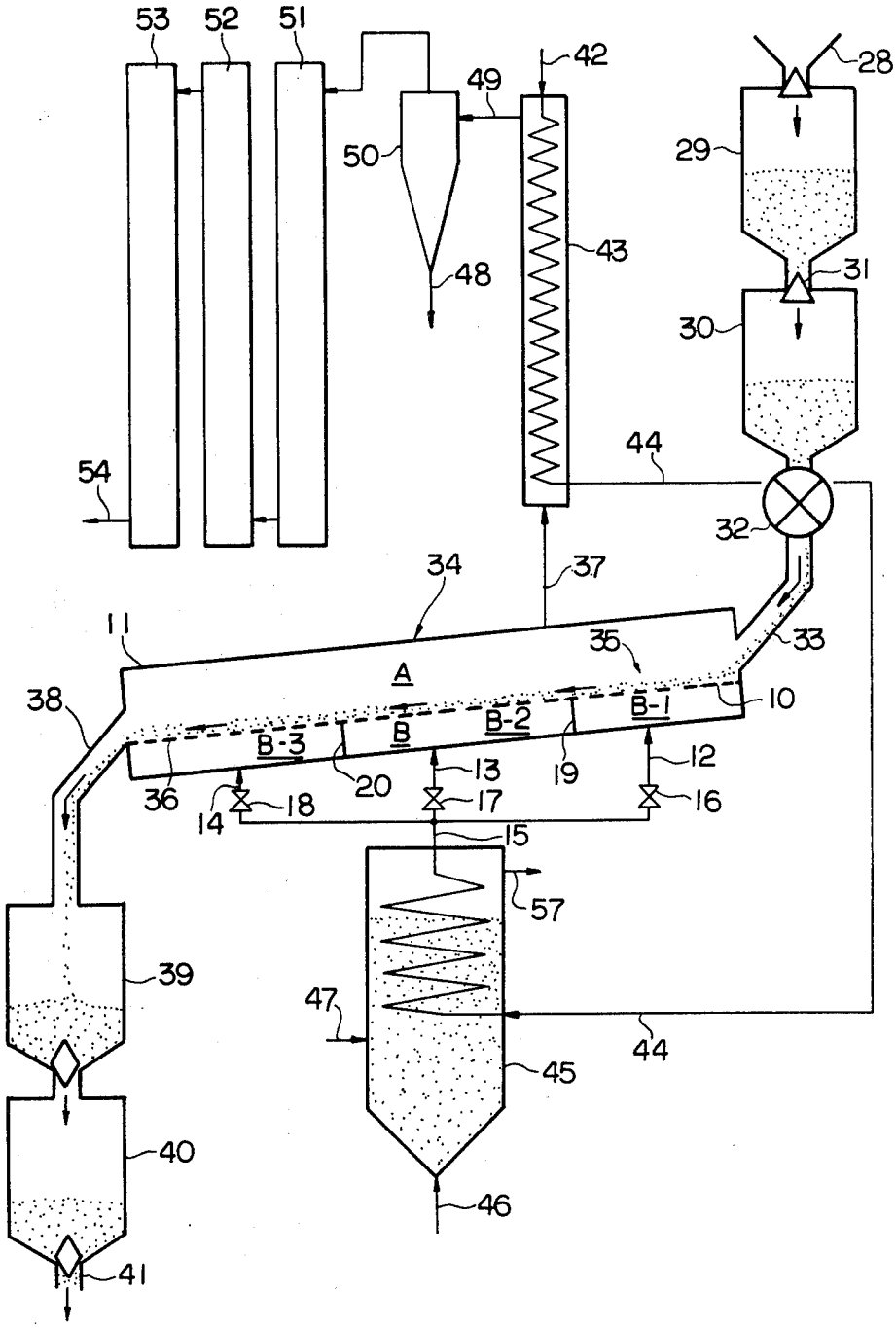
FIG. 3 is an exemplary representation diagrammatically showing an example of an apparatus system suitable for carrying out the process of the invention.
Figure 4:
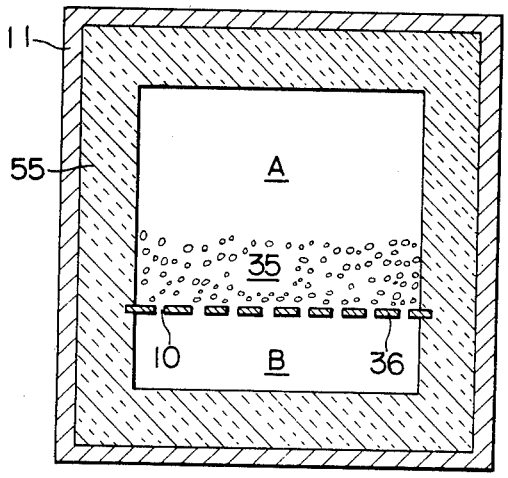
FIG. 4 is a schematic cross section of the gasification furnace of FIG. 3.

Referring to FIGS. 3 and 4, a gasification furnace 34 includes a housing 11 lined with refractory bricks 55 and defining a laterally extending reaction chamber therein. The reaction chamber is divided into an upper space A and a lower space B by a hydrogen gas dispersing plate 36 having a multiplicity of perforations 10 which permit a hydrogen gas to flow therethrough. The upper space A is provided with a coal supply conduit 33 opening into one end thereof, a discharge conduit 38 opening into the other end thereof for discharging a gasification residue of the coal and a gas discharge conduit 37 opening into the upper portion thereof for discharging a gasification product of the coal. The lower space B is provided with hydrogen gas supply conduits 12, 13, 14 which open into the lower portion thereof. In this case, the dispersing plate 36 is inclined downward from the coal supply side to the coal gasification residue discharge side of the upper space A. The lower space B is divided by partition plates 19, 20 into three compartments B-1, B-2, B-3 into which the hydrogen gas supply conduits 12, 13, 14 open, respectively.

A coal whose particle size has been adjusted to not greater than about 5 mesh is introduced from a hopper 28 into a lock hopper 29 where, after air remaining therein has been purged, the coal is pressurized to a reaction pressure. After the coal has been pressurized, a valve 31 is opened to drop the coal in a lock hopper 30. The coal is then fed, via supply conduit 33, to the upper space A of the gasification furnace with a constant feed rate by means of a coal feeder 32.

On the other hand, a hydrogen gas is first introduced from a conduit 42 into a heat exchanger 43, where the gas is preheated by indirect contact with the gasification product gas. The preheated gas is then introduced through a conduit 44 into a fluidized combustion furnace 45 for preheating hydrogen, where the hydrogen gas is preheated to a predetermined temperature, generally to 300°–800° C. Indicated as 46, 47 and 57 are a combustion air supply conduit, a fuel supply conduit and a combustion waste gas discharge pipe, respectively. The thus preheated hydrogen gas is discharged through a conduit 15 and is divided into three streams, which are fed to the compartments B-1, B-2, and B-3 of the gasification furnace through the gas supply conduits 12, 13 and 14 via hydrogen gas flow rate control valves 16, 17 and 18, respectively. The hydrogen gas fed into each compartment is blown into the upper space A through the small perforations 10 of the dispersing plate 36. Division of the lower space B into three compartments in this manner is advantageous in that each of the previously described preheat zone, reaction zone and reaction completion zone can be supplied with respective optimum amount of the hydrogen gas.

The coal supplied to the upper space A forms on the dispersing plate 36 a coal layer 35 having a constant height and moving from the supply side to the discharge side by the action of the hydrogen gas stream emitted through the dispersing plate 36 and the mechanical action created in the down grade direction of the dispersing plate 36 by the weight of the coal itself on the inclined dispersing plate 36. During the movement of the dispersing plate 36, the coal reacts with the heated hydrogen gas to produce a gas of a high heating value. The gas product is discharged through the discharge conduit 37 and is introduced into the above-described heat exchanger 43 so as to be cooled by heat exchange with the hydrogen gas fed from the conduit 42. The cooled gas is then fed through a conduit 49 to a dust separator 50 where dusts contained therein are separated through a conduit 48. The dust-free gas product is then introduced into gas purifying devices 51, 52, 53 to remove therefrom impurities such as hydrogen sulfide and is discharged through a conduit 54 for use as a fuel gas having a high heating value.

The gasification residue of the coal is removed through the discharge conduit 38 for the gasification residue and fed to lock hoppers 39, 40 where the pressure is released to atmospheric pressure. Thereafter, the residue is discharged through a discharge pipe 41. The unreacted residue of the coal can be utilized as a fuel for preheating hydrogen in the fluidized combustion furnace 45. Alternatively, the residue may be utilized as a raw material for producing hydrogen.

The gasification residue of the coal obtained according to the process of this invention is in the form of granules having greater grain sizes, i.e. 0.5–30 mm, than the starting coal powder material. That is, during the movement on the dispersing plate, the coal powder is granulated as well as hydrogenolytically gasified as described above in accordance with the present invention.

The present invention may be embodied in various forms without departing from the spirit of the invention. For example, it is possible to remove the partition plates 19, 20 or to provide additional partition plates to divide the lower space into more number of the compartments. Also, similar to the lower space B, the common space above the coal layer in the upper space A can be divided into compartments A-1, A-2, A-3 . . . . In this case, the gas product is separately discharged from each compartment A-1, A-2, A-3 . . . , and the gas product obtained from the compartments in which the hydrogen content is high can be recycled as a supply of the hydrogen gas to the lower space B. Further, the dispersing plate 36 may be covered with particles of a refractory material having a relatively high density or cokes having poor reactivity to improve the dispersion of hydrogen into the coal layer 35 so that reaction conditions and the movement of the coal layer may be improved and the thickness of the coal layer may be further reduced. The provision of such refractory material is also effective in protecting the dispersing plate from the high reaction heat. Moreover, the dispersing plate 36 may be provided with a means for accelerating the movement of the coal layer 35. Further, the process of the hydrogenolytic gasification under pressure according to this invention can be carried out using an apparatus having a plurality of the above-mentioned hydrogenolytic gasification furnaces connected in series.

INDUSTRIAL APPLICABILITY

In recent years, coals have been again given attention as an energy source to be substituted for petroleum and there is a strong desire for the development of the art of efficient coal gasification and liquifaction. According to the present invention, a gas of a high heating value can be produced from coals with high efficiency and processability as described above. Therefore, the present invention may be effectively applied as one of the methods for solving problems in energy, which become serious due to the exhausion and the rise in price of petroleum.

We claim:

1. A continuous process for hydrogenolytic gasification of coal to produce a combustible gas product comprising:

introducing powdery coal into a reaction chamber comprising an inclined gas dispersing plate and forming a layer of said powdery coal on said dispersing plate; said coal layer moving through said reaction chamber on said plate in the down grade direction of said plate;

introducing a gas consisting essentially of hydrogen through said dispersing plate into said coal layer; the amount of hydrogen gas introduced being not greater than 1 $m^3$ per Kg/coal;

reacting said powdery coal with said hydrogen gas at a temperature of 400° C. to 900° C. and a pressure of 20 $Kg/cm^2$ to 100 $Kg/cm^2$;

withdrawing coal residue from said reaction chamber, and withdrawing a combustible gas product having a heating value of 6000 $Kcal/m^3$ to 9900 $Kcal/m^3$ from said reaction chamber.

2. A process according to claim 1 wherein said coal residue is recovered in the form of granules having particle sizes from 0.5 mm to 30 mm.

3. A process according to claim 1 wherein the residence time of the coal in said reaction chamber is from 20 sec to 15 min.

4. A process according to claim 3 wherein said residence time is 30 sec to 10 min.

5. A process according to claim 1 wherein said hydrogen gas is preheated to a temperature of 300° C. to 800° C. prior to introducing said hydrogen gas into said reaction chamber.

6. A process according to claim 5 wherein said coal residue is used as a fuel for preheating said hydrogen gas.

7. A process according to claim 1 or claim 5 wherein said hydrogen gas is at least partially preheated by indirect heat exchange with product gas withdrawn from said reaction chamber.

8. A process according to claim 1 wherein said powdery coal has a particle size not greater than 6 mm.

9. A process according to claim 1 wherein said gas dispersing plate comprises a plate of heat-resistant material having perforations 0.5 mm to 3 mm in diameter therethrough; said perforations being distributed over the length and breadth of said plate with a spacing between perforations of 5 mm to 5 cm.

10. A process according to claim 1 wherein the flow velocity of said hydrogen gas introduced through said dispersing plate is 0.8 to 1.5 times the minimum fluidized velocity of the coal particles employed, and the amount of hydrogen introduced is from 0.3 to 0.7 $m^3$ per Kg/coal.

11. A process according to claim 1 or claim 2, wherein the depth of the powdery coal layer formed on the dispersing plate is between 3 cm and 1 m.

12. A process according to claim 1 wherein said combustible gas product comprises methane as its major component.

13. A process according to claim 1, wherein the inclination gradient of the dispersing plate is between 1/100 and 40/100.

14. A process according to claim 11 wherein the depth of the coal layer on said dispersing plate is 15 cm to 70 cm.

15. A process according to claim 1 or 13, wherein the flow speed of the hydrogen emitted from the surface of the dispersing plate is between 0.5 and 2 times the minimum fluidization speed of the powdery coal supplied.

* * * * *